US006820868B1

(12) United States Patent
Reymus

(10) Patent No.: US 6,820,868 B1
(45) Date of Patent: Nov. 23, 2004

(54) FASCIA BOARD HANGER

(76) Inventor: Reginald W. Reymus, P.O. Box 176, Schurz, NV (US) 89427

( * ) Notice: Subject to any disclaimer, the term of this patent is extended or adjusted under 35 U.S.C. 154(b) by 0 days.

(21) Appl. No.: 10/067,666

(22) Filed: Feb. 4, 2002

(51) Int. Cl.[7] ..... B25B 1/20

(52) U.S. Cl. ..... 269/41; 269/37; 269/45; 269/93; 269/98; 269/152; 269/153; 269/904; 33/645

(58) Field of Search ..... 269/41, 904, 98, 269/37, 45, 153, 152, 93; 33/645

(56) References Cited

U.S. PATENT DOCUMENTS 4,164,346 A * 8/1979 Sickler ..... 269/289 MR
4,836,517 A * 6/1989 Vossler ..... 269/41
5,192,059 A * 3/1993 Silver ..... 269/41
5,228,667 A * 7/1993 Bridegum ..... 269/45
5,768,830 A * 6/1998 Kelly ..... 52/127.1
6,318,711 B1 * 11/2001 Auston, Jr. ..... 269/41
6,527,265 B1 * 3/2003 Goodding ..... 269/69

* cited by examiner

*Primary Examiner*—Joseph J. Hail, III
*Assistant Examiner*—Alvin J. Grant

(57) ABSTRACT

An apparatus for temporarily suspending or supporting a fascia board during the installation thereof, along the eaves or the end of a rafter tail of a frame of a roof structure is described, wherein the device includes a U-shaped bucket (16) for supporting or suspending the fascia board. The U-shaped bucket is engaged in cooperating with a swivel bracket (10) and a rafter tail clamp saddle (4) for attachment to the end of the rafter tail, respectively, to the frame of the roof structure. The apparatus provides an improved method of installing a fascia board, wherein, one person can install the fascia board for the completion of the roof structure thereof. The apparatus can be easily removed and applied to another section of the roof.

9 Claims, 7 Drawing Sheets

FASCIA BOARD HANGER

FEDERALLY SPONSORED RESEARCH

Not Applicable

SEQUENCE LISTING OR PROGRAM

Not Applicable

BACKGROUND

1. Field of Invention

This invention enables one person to hang fascia board of various sizes from 2"×6" to 2"×12" on plumb and square cuts, on every pitch from square (90°) to 12 in 12 (45°).

BACKGROUND

2. Description of Prior Art

In many of the construction trades, the economies of modem construction necessitates that the number of craftsmen be limited to as few as possible due to the high labor cost. Labor cost is particularly high in the construction industry which, by necessity, is labor intensive because few construction practices can be reduced to automated techniques. The advances in modern construction practices have been for the most part, in improvements in the operation and efficiency of everyday tools that craftsmen use. For example, the development of automatic nailing guns, super adhesives, and tools to apply them, and better materials and prefabricated substructures has greatly improved the efficiency and speed of building construction.

Much of the improvements in the past, however, have been directed toward improving the efficiency of the individual craftsman. There are, however, much needed improvements in overall construction practices which will lead to a reduction in the number of needed craftsmen, and thus, a corresponding reduction in construction cost. One such area is the hanging of fascia board to the ends of rafters during the construction of a home, which in the past has been a two or three-man job.

In conventional home construction, the rafters slant downward from the peak of the roof to the upper edge of the wall. Boards are laid on the upper surface of the rafters to form the roof. The rafters and roof extend beyond the wall and eave troughs at the edge of the roof receive the rain runoff from the roof. The eave troughs are mounted on fascia boards fastened to the ends of the rafters and lay parallel to the wall of the house.

Inventors have created several types of fascia board hangers to attach fascia board along the edges of rafters. U.S. Pat. No. 5,611,189 to Fleck (1997) is for an apparatus to support fascia board during installation along the rafters of a roof. However, this apparatus does not have a swivel bracket to adjust to all pitches of a roof structure. Thus, the device can only be used on a plumb cut rafter tail. The device is limited and can not be used on a square cut rafter tail.

U.S. Pat. No. 5,192,059 to Silver (1993) is a fascia board holder with a U-shaped channel that is rigidly mounted on quadrant which provides for no adjustment for varying sized fascia board. The device is only useable for one size rafter. The device does not show pitch marks to select angular position to lock the quadrant relative to the pitch of the roof.

U.S. Pat. No. 4,836,517 to Vossler (1989) shows a fascia board installing apparatus, but it is unclear how the fascia board installing apparatus would be removed after the fascia board is attached to rafter tail.

These patents, or known prior uses, teach and disclose various types of support devices, as well as methods of their construction; but none of them, whether taken individually or in combination disclose specific details of the combination of the inventions as to bear upon the claims of my fascia board hanger.

Temporary hangers may, of course, be used to hold up and align multiple fascia boards and numerous devices, such as those described in the Fleck and Vossler patents. None of the prior art devices, however, take into consideration that roof pitches vary from building to building, so they were not adjustable for different roof pitches.

Accordingly, several objects and advantages of my fascia board hanger are:

(a) The rafter clamp saddle can be used on any sized rafter.

(b) The swivel bracket may be adjusted and locked in position to accommodate varying roof pitches. Pitch increments are stamped on swivel bracket.

(c) The fascia bucket may be adjusted and locked in various positions to receive and secure different-sized fascia boards.

An additional advantage is my fascia board hanger is very light weight for carrying on tool belts. The hanger can be removed very simply after fascia board is attached. The hanger is made of very sturdy 3/16" aluminum. While reference to fabrication in aluminum has been made, other materials such as plastics or steel may well be equally employed.

SUMMARY

In accordance with information presented, the fascia board hanger enables one person to use the rafter clamp to secure the hanger bracket on the rafter, to use the swivel bracket for securing the desired pitch, and the hanger bucket to support the fascia board. The hanger bucket also slides up and down for easy removal. It is a specific object of the fascia hanger to be easy to install, use, and remove.

The fascia board hanger is low in cost and at the same time, is sturdy in construction.

Another object of the fascia board hanger is one worker can install fascia board along the ends of rafters which reduces labor cost.

It is still another object of my hanger to be fully adjustable for the relative height of fascia to the top of the rafter during the installation process. After the fascia is installed, it provides yieldable means for removal.

DRAWINGS

Drawing Figures

In the drawings, closely related figures have the same number but different alphabetic suffixes.

REFERENCE NUMERALS IN DRAWINGS

Figure 2:
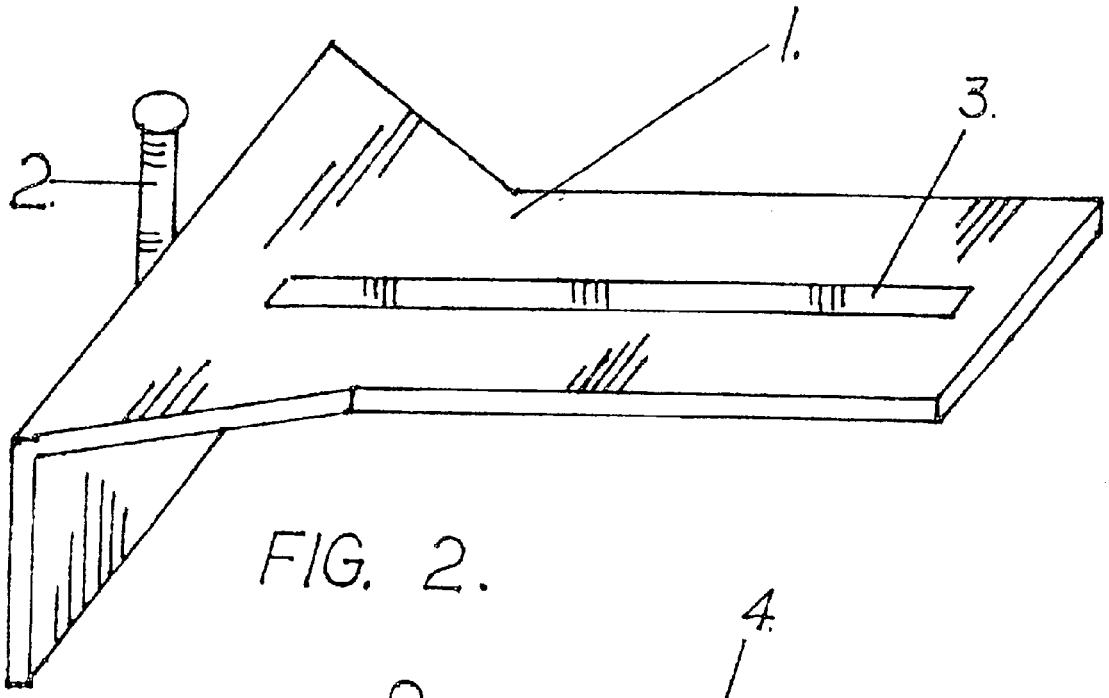
FIGS. 1-2 show the assembly parts of the rafter clamp or saddle.

1 sliding rafter tail clamp
2 rafter tail clamp tightener
3 ¼"
4 rafter tail clamp saddle
5,6,7,8 ¼" threaded studs
9 pitch marks
10 swivel bracket
11, 12 ¼" threaded stud
14, 15 ¼" groove
16 hanger bucket
17, 18, 19,20,21,22 wing nuts
23 rafter tail
24 2"×6" fascia board

DETAILED DESCRIPTION

Description

Figure 1:
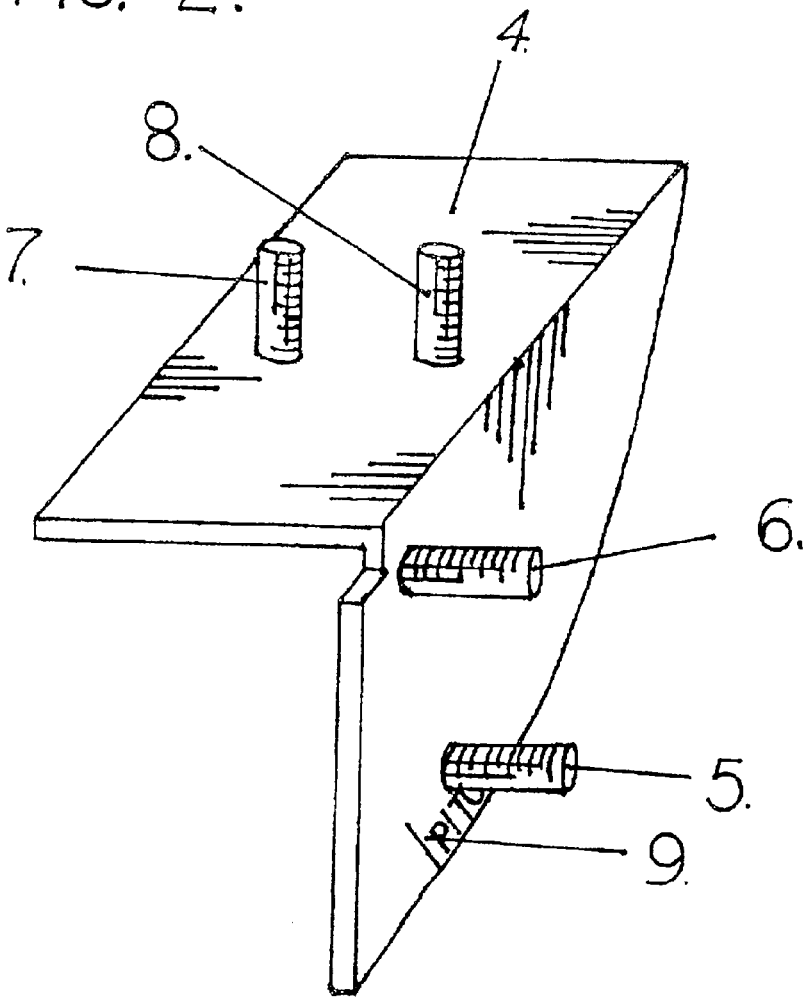

FIGS. 1-2—Preferred Embodiment

The fascia board hanger is now described with reference to the drawings. FIGS. 1 and 2 illustrate one embodiment of applicant's fascia board hanger which is referenced to FIGS. 9 and 4 attached to rafter tail.

Figure 3:
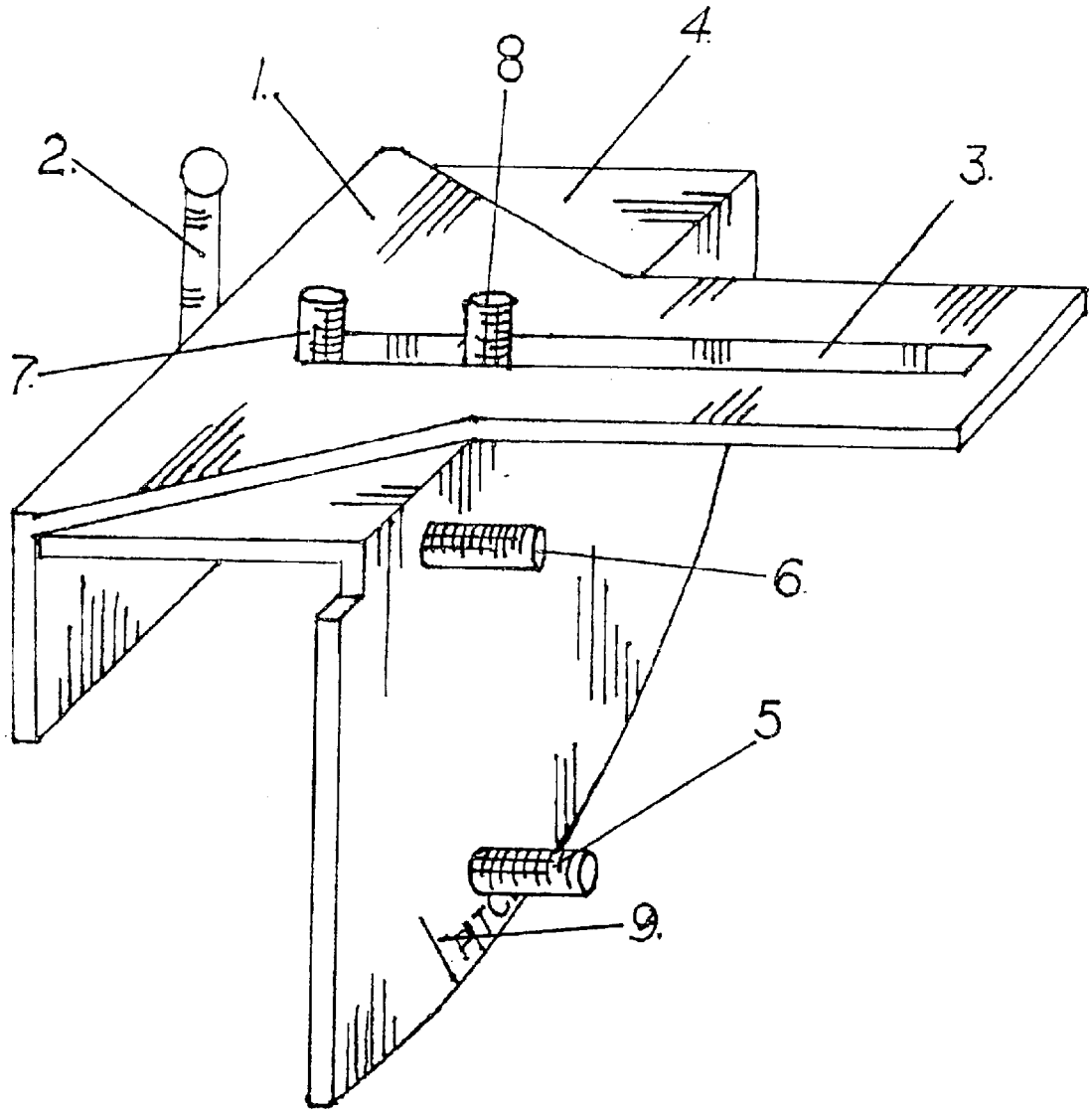
FIG. 3 shows the rafter clamp or saddle assembled.

FIG. 3, as in the case of a house rafter 23, extends beyond exterior wall at a conventional angle for a conventional length. The hanger is attached to rafter 23 with a saddle bracket. A holder portion 10 of the hanger swivels about pivot point 6 in accordance with the end cut of rafter.

Figure 4:
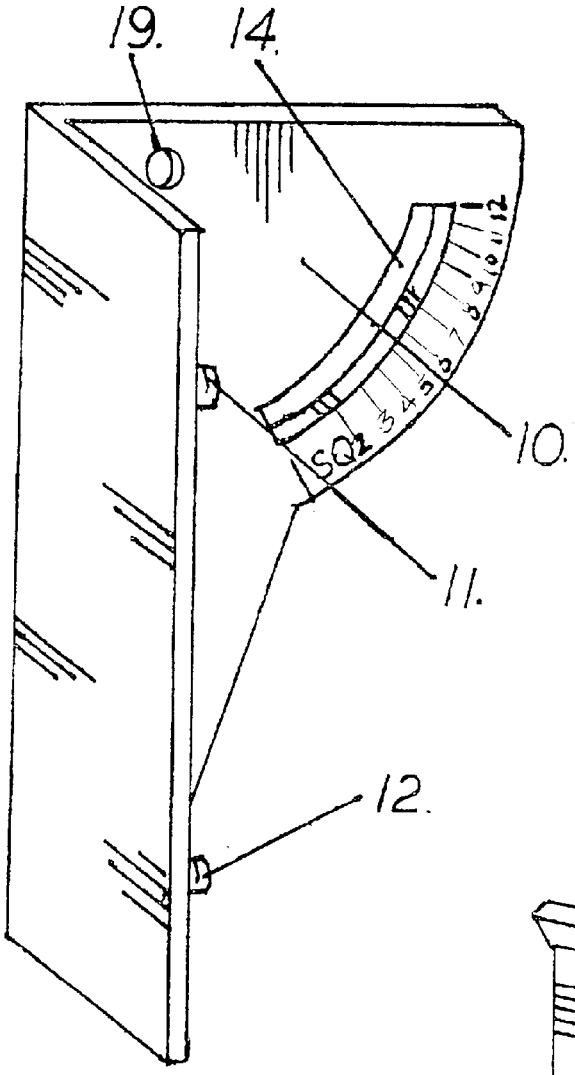
FIG. 4 shows the swivel bracket for adjustment of pitch.
Figure 5:
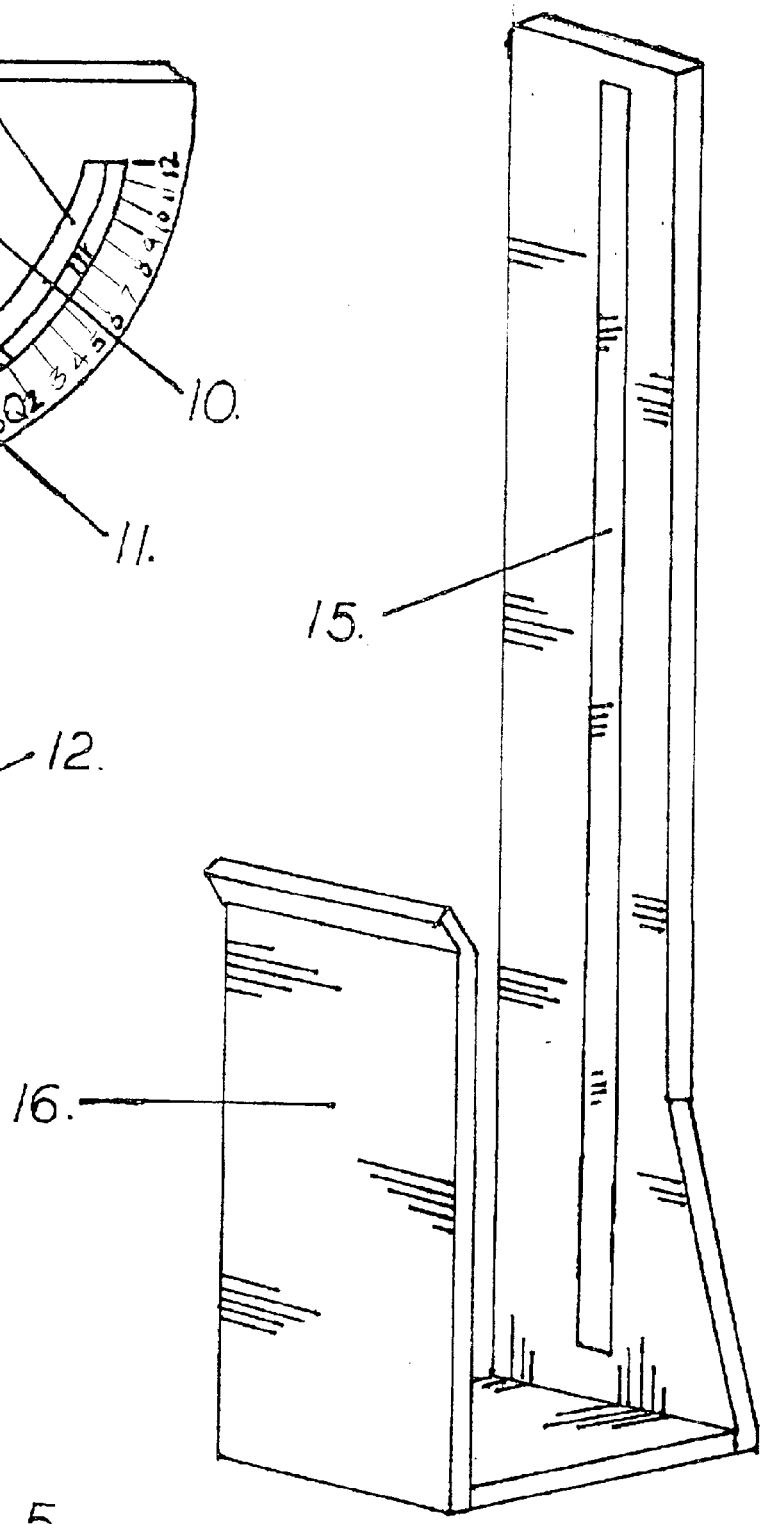
FIG. 5 shows the fascia bucket for adjustment to size of fascia board to be used.

FIGS. 4 and 5 illustrate two major components of applicant's fascia hanger. As shown in the drawing holder 10 is formed of adjusting channel 15 and bucket 16 which are attached to channel 15 with studs 11 and 12 which are attached to swivel bracket 10 and secured to respective saddle 1 and 4 by securing wing nuts 19 and 20 on swivel bracket 10.

Figure 6:
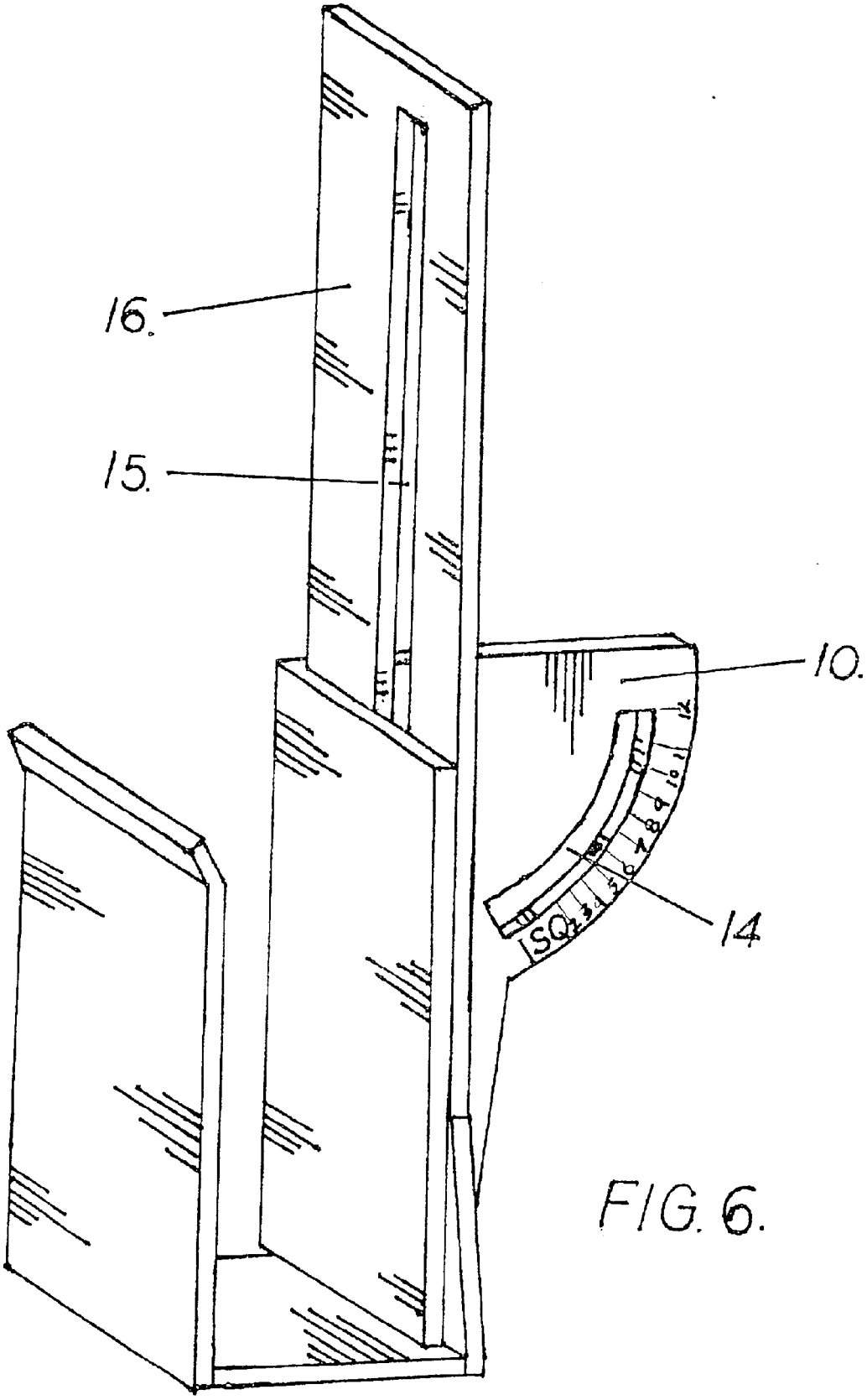
FIG. 6 shows the swivel bracket and fascia bucket assembled.

FIG. 6 bracket 10 is attached to channel 15 by wing nuts 19 and 20 internally threaded to receive threaded studs 11 and 12 attached to swivel bracket 10 through channel 15 and secured by wing nuts 19 and 20. Slot channel 15 in fascia bucket 16 is marked with a graduated scale in increments of inches and fractions of inches as shown in FIG. 7 to permit adjustment for desired fascia board width.

The graduations permit wing nuts 19 and 20 to be repeatedly set to different positions accurately. Where two or more fascia board hangers are used to hang fascia board, the graduated scale allows the catches in each hanger to be set to the same relative position with respect to channel 15.

Figure 7:
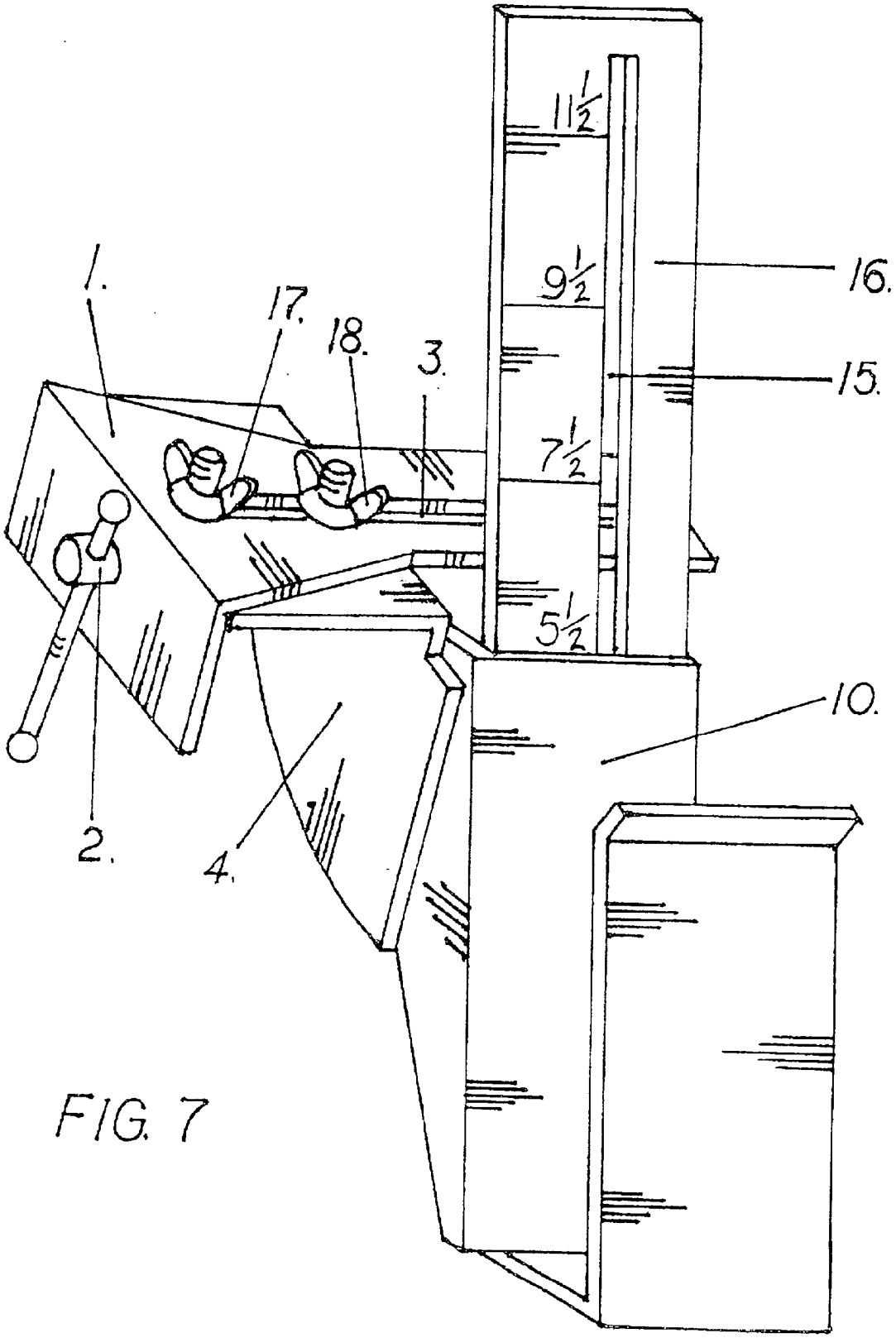
FIG. 7 is an elevation view showing embodiment of the fascia hanger of applicant's invention assembled.

FIG. 7 illustrates still further embodiment of applicant's fascia hanger. In this embodiment, fascia bucket 16 is attached to swivel bracket 10 with threaded studs 11 and 12 secured by wing nuts 19 and 20. The vertical position of fascia bucket 16 can be adjusted by loosening and tightening wing nuts 19 and 20 once desired increments on fascia bucket 16 are located; then the bucket 16 can be secured.

Figure 8:
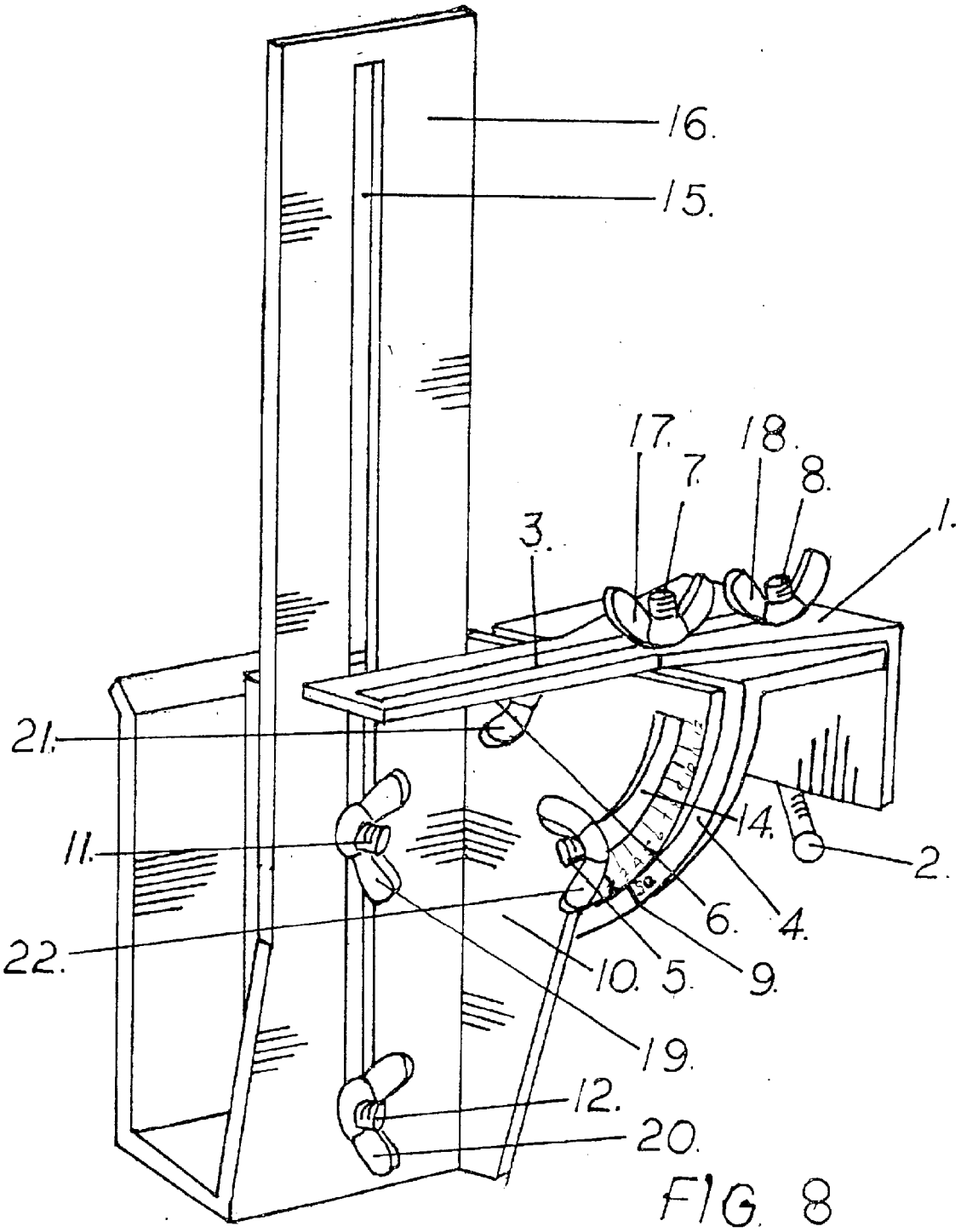
FIG. 8 is an elevation view showing embodiment of the fascia hanger of applicant's invention from the backside of the hanger, assembled.

FIG. 8 illustrates another embodiment of the present invention. This embodiment shows various components which are used to form clinching wing nuts 19 and 20. The components include threaded studs 11, 12, 7, 8, 5, 6 wing nuts 19, 20, 17 and 18. Sliding rafter tail clamp 1 sliding rafter tail clamp tightener 2, ¼" channel groove 3 rafter tail clamp saddle 4 swivel bracket ¼" groove 15 hanger bracket bucket 16.

Figure 9:
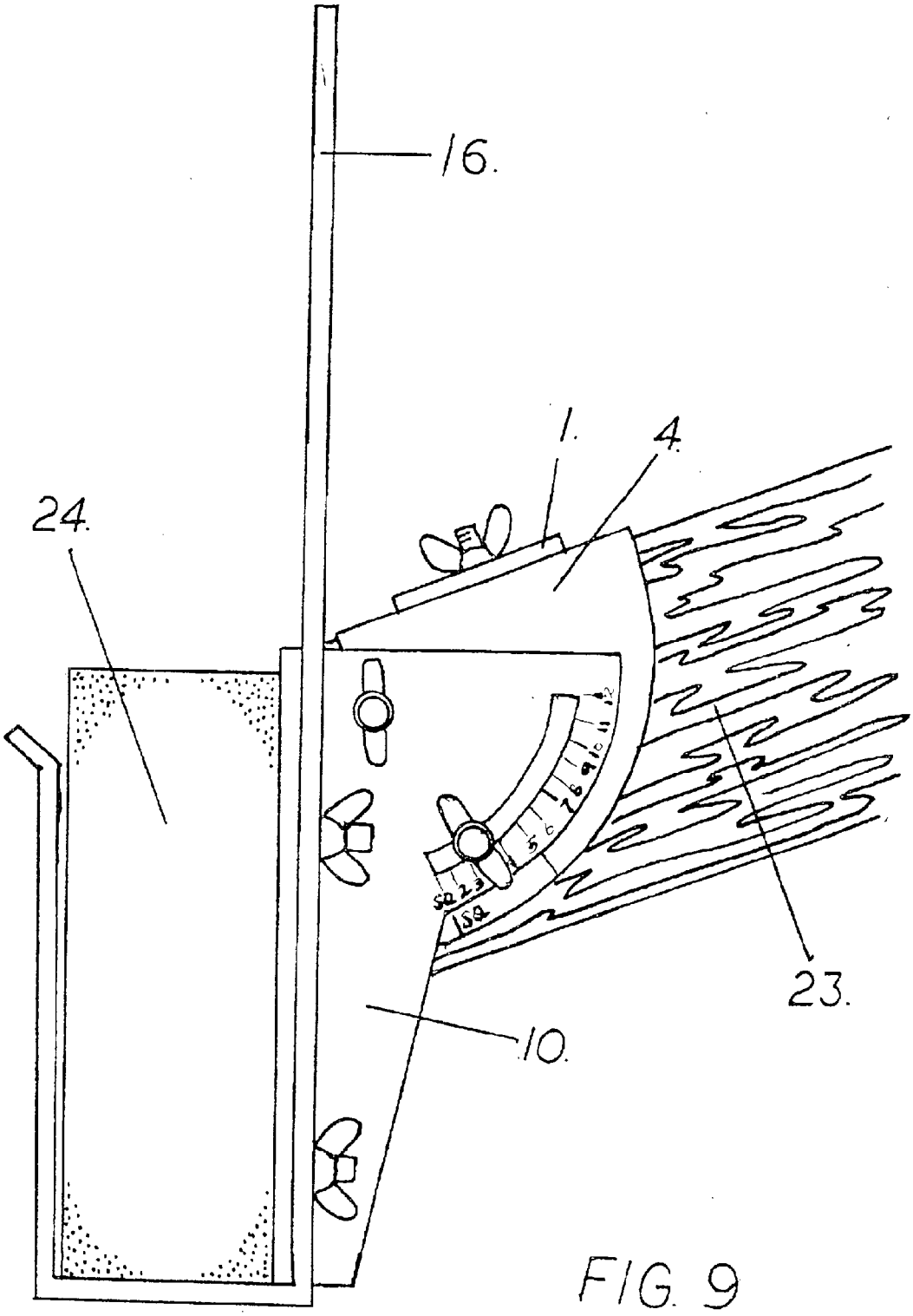
FIG. 9 is an elevation view showing one embodiment of fascia hanger of applicant's invention attached to a rafter.

FIG. 9 is an elevation view showing one embodiment of fascia hanger of applicant's invention attached to a rafter tail.

Operation

FIGS. 1, 4, 6

FIG. 1 illustrates how the rafter tail clamp saddle straddles the rafter tail and supports the rest of the hanger bucket 16. The saddle uses two quarter inch bolts with locking nuts. It is used for pivoting and securing the swivel bracket 10 after the pitch is selected. The rafter clamp also has a pitch mark on it. The pitch mark 9 is essential to establish the correct setting of the swivel bracket to match the pitch, or degree, of the rafter cut being used. Clamp also extends from 1½" to 3½" with a sliding bracket secured with two locking wing nuts.

FIG. 4 illustrates the swivel bracket which attaches to the rafter clamp and rotates from square (90°) to 12 in 12 (45°). The bracket has pitch markings stamped on it which range from square through 12 in 12. When the pitch mark on the swivel bracket is lined up with the pitch mark on the rafter clamp, it can be secured by tightening the locking wing nuts 17 and 18, once the desire pitch is determined. The swivel bracket attachment also supports the hanger bucket 16. The swivel bracket has two quarter inch bolts with wing nuts which can be loosened to allow the hanger to slide up and down to the desired width of fascia board. The bucket is secured with the two locking wing nuts.

FIG. 6 is the hanger bucket which is attached to the swivel bracket. The hanger bucket 16 supports the fascia board and slides up and down on the back side of the swivel bracket. The swivel bracket is marked from 5½ (2"×6"); 7½ (2"×8"); 9½ (2"×10"); 11½ (2"×12") markings for square or 90° cuts only. Hanger bucket is layed out in ¼" increments. (It is not necessary to lay it out in ⅛ths or less.) The fascia board will drop from ¼ to 1" on a plumb-cut to keep the fascia board on the same plane as the rafter. The installer judges how far the fascia board will drop on a plumb-cut The drop, or plane, of the fascia board depends on the pitch of the roof, or rafter cut, being used. Once plane is determined, the installer tightens the two locking wing nuts on the back of the swivel bracket to secure the hanger in place. Hanger bucket also widens at the bottom to 2" for balancing fascia board, which is critical when using only one fascia board hanger. This bracket enables installers to hang fascia board alone using only one hanger. Installer may use two hangers when heavier material is being used.

Conclusion, Ramifications, and Scope

The foregoing is considered as illustrative only of the principles of the invention. Further, since numerous modifications and changes will readily occur to those skilled in the art, it is not desired to limit the invention to the exact construction and operation shown and described, and accordingly, all suitable modifications, and equivalents which may be resorted to, will be understood to fall within the scope of the invention. The primary advantage of my hanger is to enable installers to hang fascia board from sizes 2×6 to 2×12 on plumb and square cuts, on every pitch from square (90°) to 12 in 12 (45°) alone.

I claim:

1. A fascia board hanger, comprising:

a hanger bucket member, the hanger bucket member having a U-shaped channel sufficiently dimensioned to receive and support a facie board;

a rafter clamp member, the rafter clamp member having a U-shaped channel sufficiently dimensioned to receive and be fastened to a rafter by the clamping member;

a swivel bracket member, the swivel bracket member having a first member and a second member, the first and second members connected to each other edgewise in a substantially perpendicular relationship, wherein the first member is connected to the hanger bucket member and the second member is connected to the rafter damp member, thereby placing the fascia board in a substantially perpendicular relationship with the rafter, wherein the second member of the swivel bracket member has a swivel means for adjusting the hanger bucket member to align with the angle of the rafter edge.

2. The fascia board hanger of claim 1, wherein the hanger bucket member comprises a first member, a second member, and a third member, the first and second members arranged opposite each other in a substantially parallel relationship, the first and second member separated by a third member such that the first, second and third member form the U-shaped channel.

3. The fascia board hanger of claim 2, wherein the second member of the hanger bucket member comprises markings that indicate width of a fascia board when placed within the U-shaped channel of the hanger bucket member.

4. The fascia board hanger of claim 2, wherein the second member of the hanger bucket member comprises an elongated aperture through which the swivel bracket member attaches to the hanger bucket member, thereby allowing the hanger bucket member to be slidably adjusted to accommodate fascia boards of varying widths.

5. The fascia board hanger of claim 1, wherein the rafter clamp member comprises a first member, a second member, a third member, and a clamping member, the first and second members arranged opposite each other in a substantially parallel relationship, the first and second member separated by a third member such that the first, second and third member form the U-shaped channel and the clamping member fastens the rafter clamp member to a rafter.

6. The fascia board hanger of claim 5, wherein the third member of the rafter clamp member comprises a first element and a second element, said first element having a threaded stud protruding outward, the second element having a slotted aperture through which the threaded stud protrudes and is received by a threaded nut, wherein the first and second elements can be fastened together at one of a plurality of positions to allow the third member to adjustably accommodate the rafter.

7. The fascia board hanger of claim 5, wherein the swivel means comprises the second member of the rafter clamp member having a first stud and a second threaded stud, the second member of the swivel bracket member having a first aperture receiving the first stud, and a second, slotted aperture having a substantially curved shape, the second aperture receiving the second stud, the first stud acting as a pivot around which the second member of the swivel bracket member rotates, and the second stud acting as a fastener by protruding through the slotted aperture and being received by a threaded nut.

8. The fascia board hanger of claim 7, wherein the second member of the rafter clamp member has a reference mark, and the second member of the swivel bracket member has a plurality of alignment marks located proximate to the slotted aperture such that the swivel bracket member can be rotated with respect to the rafter clamp member to place the alignment marks in proximity to the reference mark to indicate the angle of the rafter edge.

9. The fascia board hanger of claim 7, wherein the second member of swivel bracket member has a third aperture, and the second member of the rafter clamp member has an alignment aperture, wherein the swivel bracket member can be adjusted to align the third aperture and the alignment aperture, and a fastener can be placed through the third aperture and alignment aperture to lock the swivel bracket member in a desired orientation with respect to the rafter clamp member.

* * * * *